US007475660B2

(12) United States Patent
Lichtenwald et al.

(10) Patent No.: US 7,475,660 B2
(45) Date of Patent: Jan. 13, 2009

(54) CAMSHAFT ADJUSTER

(75) Inventors: Viktor Lichtenwald, Nurnberg (DE); Jochen Auchter, Weisendorf (DE); Andreas Strauss, Forchheim (DE); Rudolf Eydam, Geisfeld (DE); Andreas Rohr, Heroldsbach (DE); Harald Elendt, Altendorf (DE); Ulrich Wierl, Mendorf (DE); Jens Hoppe, Erlangen (DE); Rainer Ottersbach, Aurachtal (DE)

(73) Assignee: INA-Schaeffler KG, Herzogenaurach (DE)

( * ) Notice: Subject to any disclaimer, the term of this patent is extended or adjusted under 35 U.S.C. 154(b) by 67 days.

(21) Appl. No.: 11/143,343

(22) Filed: Jun. 2, 2005

(65) Prior Publication Data

US 2006/0278187 A1 Dec. 14, 2006

(30) Foreign Application Priority Data

Jun. 2, 2004 (DE) ..... 10 2004 026 863

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 4,983,797 A * 1/1991 McAllister et al. ..... 219/121.64
5,931,272 A * 8/1999 Fukushima et al. ..... 192/54.52
5,988,126 A 11/1999 Strauss et al.
6,085,708 A 7/2000 Trzmiel et al.
6,155,219 A * 12/2000 Fukuhara et al. ..... 123/90.17
6,176,210 B1 1/2001 Lichti et al.
2004/0244745 A1 * 12/2004 Palesch et al. ..... 123/90.17
2005/0051123 A1 3/2005 Haser et al.
2005/0109298 A1 * 5/2005 Bolz et al. ..... 123/90.17
2005/0115529 A1 6/2005 Haser et al.

FOREIGN PATENT DOCUMENTS

DE 4204814 A1 * 8/1993
DE 196 12 397 10/1997
EP 1 500 793 7/2004

OTHER PUBLICATIONS

Abstract of DE4204814A1.*

* cited by examiner

*Primary Examiner*—Zelalem Eshete
(74) *Attorney, Agent, or Firm*—Volpe and Koenig PC

(57) ABSTRACT

An internal-combustion engine with a device for adjusting the rotational angle (camshaft adjuster (1)) of a camshaft (2) relative to a crankshaft is provided. The device comprises a driving wheel (3) connected in a rotationally locked way to the crankshaft, a driven part (6) connected in a rotationally locked way to the camshaft (2), and an adjusting mechanism, with which the phase position between the crankshaft and camshaft (2) can be set and maintained in a certain range of angles. A reduction of the required axial structural space of the camshaft adjuster (1) and the number of individual parts is achieved in that the driven part (6) is fixed to the camshaft (2) with a frictional, positive-fit, or interference-fit connection.

4 Claims, 2 Drawing Sheets

CAMSHAFT ADJUSTER

BACKGROUND

The invention relates to a camshaft adjuster for adjusting and fixing the phase position of a camshaft of an internal-combustion engine relative to the crankshaft, with a driving wheel connected to the crankshaft in a rotationally locked way via a suitable drive, with a camshaft-fixed driven part, which is mounted on a camshaft or on an extension of the camshaft and which is driven by the driving wheel, with the phase position of the driven part being adjustable relative to the driving wheel within a certain range of angles.

In internal-combustion engines, camshafts are used to activate the gas exchange valves. The camshaft is mounted in the internal-combustion engine such that cam followers, for example, cup tappets, finger levers, or valve rockers, contact cams mounted in the engine. If the camshaft is set in rotation, then the cams roll on the cam followers, which in turn activate the gas exchange valves. Thus, the position and the shape of the cams sets both the open period, as well as the amplitude, but also the opening and closing times of the gas exchange valves.

Modern engine concepts are directed towards designing the valve drive to be more variable. On one hand, the valve stroke and valve open period should be variably configurable up to the complete deactivation of individual cylinders. For this purpose, concepts, such as switchable cam followers or electrohydraulic or electric valve drive actuators, have been provided. Furthermore, it has been shown to be advantageous to be able to influence the opening and closing times of the gas exchange valves during the operation of the internal-combustion engine. It is also desirable to be able to influence the opening or closing times of the inlet or outlet gas exchange valves separately, in order, for example, to be able to set a defined gas exchange valve overlap. Through the targeted setting of the opening or closing times of the gas exchange valves as a function of the current characteristic field range of the engine, for example, of the current engine speed or the current load, the specific fuel consumption can be reduced, the exhaust-gas ratio can be positively influenced, and the engine efficiency, the maximum torque, and the maximum power can be increased.

The described variability in the gas exchange valve time control is implemented through a relative change of the phase position of the camshaft to the crankshaft. Here, the camshaft is usually in direct driven connection with the crankshaft via a chain, belt, or gear wheel drive. A camshaft adjuster, which transfers the torque from the crankshaft to the camshaft, is mounted between the chain, belt, or gear wheel drive and the camshaft. Here, this adjusting device is embodied such that during the operation of the internal-combustion engine, the phase position between the crankshaft and camshaft is maintained reliably and when desired, the camshaft can be rotated into a certain range of angles relative to the crankshaft.

In internal-combustion engines with a camshaft for the inlet and outlet valves, these valves can each be equipped with a camshaft adjuster. Therefore, the opening and closing times of the inlet and outlet gas exchange valves can be shifted in time relative to each other and the overlap of the gas exchange valve times can be set as desired.

The basis of modern camshaft adjusters is located in general on the drive-side end of the camshaft. It comprises a driving wheel fixed to the crankshaft, a driven part fixed to the camshaft, and an adjusting mechanism transferring the torque from the driving wheel to the driven part. The driving wheel can be configured as a chain, belt, or gear wheel, and is connected to the crankshaft in a rotationally locked way by means of a chain, a belt, or a gear wheel drive. The adjusting mechanism can be operated electrically, hydraulically, or pneumatically.

Electrical adjusting mechanisms are constructed as so-called three-shaft drives. Here, a first shaft (the driving wheel) is in connection, via a linkage, which is driven by means of a second shaft (the adjusting shaft), with a third shaft (the driven part). The adjusting shaft of the linkage is driven by means of an electric motor. Planetary gears, internal eccentric gears, double internal eccentric gears, shaft gears, or wobble-plate gears, for example, are conceivable as the linkage.

In hydraulically operated camshaft adjusters, one differentiates between so-called axial-piston adjusters and rotary-piston adjusters.

In the axial-piston adjusters, the driving wheel is in connection with a piston via oblique gearing. Furthermore, the piston is in connection with the driven part likewise via oblique gearing. The piston separates a hollow space formed by the driven part and the driving wheel into two compression chambers arranged axially relative to each other. Now, if one compression chamber is charged with a hydraulic medium, while the other compression chamber is connected to an oil outlet, then the piston is displaced in the axial direction. By means of the two oblique gearings, this axial displacement creates a relative rotation of the driving wheel to the driven part and thus of the camshaft to the crankshaft.

In a rotary-piston adjuster, the driving wheel is connected in a rotationally locked way to a stator. The stator and the driven part are arranged concentric to each other. The radial intermediate space between these two components accommodates at least one, but usually several, hollow spaces spaced apart in the circumferential direction. The hollow spaces are bounded in a pressure-tight way by side walls in the axial direction. A vane connected to the driven part extends into each of these hollow spaces. This vane divides each hollow space into two compression chambers. Through targeted connection of the individual compression chambers with a hydraulic-means pump or with a hydraulic-means outlet, the phase of the camshaft relative to the crankshaft can be set or maintained.

To control the camshaft adjuster, sensors detect the characteristic data of the engine, such as, for example, the load state and the engine speed. This data is fed to an electronic control unit, which, after comparing the data with a characteristic data field of the internal-combustion engine, controls the adjusting motor of the camshaft adjuster or the inflow and the outflow of hydraulic means to the various compression chambers.

A camshaft adjuster for adjusting and fixing the phase position of a camshaft of an internal-combustion engine relative to its crankshaft according to the state of the art is known from DE 101 61 701 A1. In this publication, a driven part is fixed to a camshaft by means of a central screw. The driven part is arranged concentric to the driving part. In the radial intermediate space between driving wheel and driven part, several hollow spaces are formed, which are closed in a pressure-tight way by side walls in the axial direction. Vanes fixed to the driven part project into these hollow spaces, whereby two compression chambers are formed in each hollow space. The driven part is fixed with the help of a central screw, whereby the driven part is screwed onto the camshaft in the axial direction. The connection is established with a frictional lock through the axial force of the attachment means, which act upon a clamping surface arranged perpendicular to the axial force between the camshaft adjusting unit and the camshaft. The centering of the camshaft adjuster to the camshaft is realized through a complementary connection with radial play.

This actually good solution brings along the disadvantage of an increased axial structural space requirement due to the screw head. Because certain distances between the engine and chassis must be maintained in vehicles for reasons of safety, it is desirable to keep the axial structural space requirement of the camshaft adjuster to a minimum.

Furthermore, in this solution a small eccentricity due to the centering play between the camshaft adjusting unit and the camshaft must be taken into account.

Through the frictional connection of the driven part to the camshaft by means of the central screw, additional stresses are fed into the driven part and the camshaft. To reduce these stresses, in one embodiment, between the driven part and camshaft, there is a sleeve provided with a friction lining, whereby the stress is reduced but not sufficiently overcome.

Furthermore, solid axial clamping surfaces and threading in the camshaft are necessary, whereby considerable additional expense for their production and a high system weight must be taken into account.

Another such camshaft adjuster is described in DE 198 48 607. This is similar to the embodiment from DE 101 61 701 A1. A central screw, which connects the driven part to the camshaft, is arranged in turn within a central bore hole of the driven part. A central valve, which is used for controlling the flow of hydraulic medium to and from the various compression chambers, is integrated in the central screw. In this embodiment, the increased stress on the central valve due to the central screw function has a disadvantageous effect on the device.

SUMMARY

Therefore, the invention is based on the problem of preventing these mentioned disadvantages and thus creating a camshaft adjuster, whose axial structural space is minimized. Furthermore, the stress of the driven part should be reduced in comparison with the embodiment known from the state of the art, in which the attachment to the camshaft is realized by means of a central screw, and the eccentricity between the camshaft adjuster and camshaft should be reduced.

This problem is solved according to the invention in that the driven part is fixed with a frictional connection to the camshaft or the extension of the camshaft. Through this attachment method according to the invention of the driven part to the camshaft, not only is the axial structural space minimized and the stress of the driven part and the camshaft reduced by the elimination of the central screw, but the eccentricity is also reduced to a minimum through the force-fit connection. Furthermore, the assembly of the driving part to the camshaft is simplified and the number of components is reduced, whereby the costs for the entire unit are significantly reduced.

In one advantageous reduction of the invention to practice, the driven part is pushed over the camshaft or the extension of the camshaft and fixed to the camshaft or the extension of the camshaft through a thermal shrinking process with a frictional connection and in a rotationally locked way. Alternatively, the driven part can be embodied with a projection, which extends axially and over which the camshaft or the extension of the camshaft is pushed and fixed with a frictional connection and in a rotationally locked way by a thermal shrinking process.

In this embodiment, the outer lying component is heated, which increases its inner diameter. The inner diameter of the outer component is selected so that it can be pushed over the inner component with a small play in the heated state. During the cooling process, the inner diameter of the outer component shrinks back to its original size, whereby a frictional connection is created between the inner and outer component, which fixes the components to each other both in the axial and also circumferential directions.

In another configuration of the invention, the driven part is pushed over the camshaft or the extension of the camshaft and the camshaft or the extension of the camshaft is fixed with a frictional connection and in a rotationally locked way to the driving wheel through an expansion process. Alternatively, the driven part is embodied with a projection, which extends in the axial direction and over which the camshaft or the extension of the camshaft is pushed, and at least the projection is fixed to the camshaft or the extension of the camshaft with a frictional connection and in a rotationally fixed way through an expansion process.

In these embodiments, the outer component is pushed over the inner component and then the inner component is expanded with the help of suitable means until a frictional connection between the inner and outer components is created. In this way, the expansion of the inner component can be realized through internal high-pressure deformation by means of a compressed medium. Pressing a suitable tool through the hollow inner component represents another possibility. Here, the tool can be a ball of suitable diameter or a profiled inner mandrel, which is configured, for example, in the shape of a polygon or star. While being pushed through the hollow inner component, the tool expands the inner and outer diameters of this component, which results in an interference fit between the inner and outer components in the region, in which the components lie one above the other. In the case of a profiled inner mandrel, in addition to the frictional connection, a positive-fit connection directed in the circumferential direction of the components can likewise be achieved.

In alternative configurations of the invention, the driven part is fixed to the camshaft or the extension of the camshaft by means of an adhesive connection, a solder connection, or a weld connection.

These solutions also realize the advantages described above, such as low stress, minimal axial structural space, and cost-effective connection methods. In the weld connection, a laser-welding method is to be used in order to prevent material warping due to the application of heat.

In another alternative configuration of the invention, the driven part is fixed with a positive fit to the camshaft or the extension of the camshaft. Here, the driven part is formed with an axially extending projection, over which the camshaft or the extension of the camshaft is pushed. The outer surface of the projection is configured with at least one local section of reduced diameter, into which material of the camshaft or the extension of the camshaft is displaced. This material can be, for example, rolled round in the molding. The local section of reduced diameter can be an annular groove surrounding the projection or there can be several local sections of reduced diameter, which are spaced apart from each other in the axial or circumferential direction, whereby a positive fit can also be achieved in the circumferential direction.

Alternatively, the driven part is formed with an axially extending projection, which is pushed over the camshaft or the extension of the camshaft, wherein the outer surface of the camshaft or the extension of the camshaft is embodied with at least one local section of reduced diameter, into which material of the projection is displaced, for example, through round rolling. Here, the local section of reduced diameter can be an annular groove surrounding each component or several radial deformations, which are spaced apart from each other in the axial or circumferential direction.

Also in this embodiment, through the reduction of the number of components in the entire system and the simple assembly, a cost-effective connection method is presented. In addition, the stresses of the components to be connected and the axial structural space requirements are reduced.

It is further proposed that the connecting outer surfaces of the driven part and the camshaft or the extension of the camshaft are formed with polygonal cross-sectional shapes. Through the polygonal configuration of the outer surfaces, a positive-fit connection is also created in the circumferential direction in addition to the frictional connection.

Another essential advantage of all of the proposed connection methods is that a very exact setting of the driving wheel relative to the cams can be performed in the assembly of the camshaft adjuster on the camshaft. In all of the presented connection variants, both the camshaft adjuster and also the camshaft can be held in an exact position. The relative position of the components to each other is thus fixed before the creation of the connection and can be maintained in this exact position during the production of the connection, in contrast with the production of a screw connection. Therefore, initial deviations up to a few degrees can be prevented, which would have to be continuously compensated for during the operation of the camshaft adjuster.

BRIEF DESCRIPTION OF THE DRAWINGS

Additional features of the invention follow from the description below and from the drawings, in which embodiments of the invention are shown in a simplified form. In the drawings.

DETAILED DESCRIPTION OF THE PREFERRED EMBODIMENTS

In the following, the invention is presented with reference to an exemplary embodiment of a rotary-piston adjuster. It is mentioned explicitly that this invention can also be used in other camshaft adjusters, such as, e.g., hydraulically operating axial piston adjusters or electrical camshaft adjusters, which are adjusted by means of a mechanical gear and an electric motor driving this gear.

Figure 1:
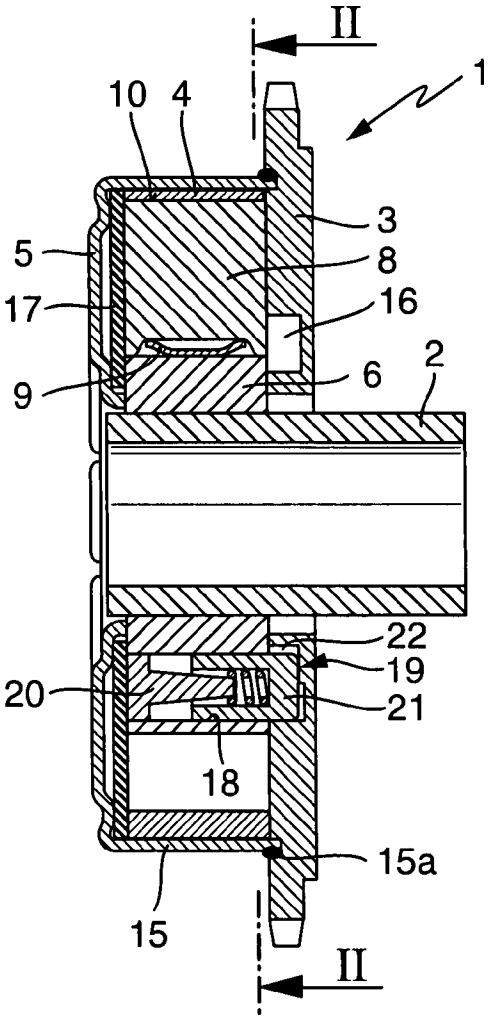
FIG. 1 is a longitudinal section view of a camshaft adjuster according to the invention from FIG. 2 taken along the line I-I.
Figure 2:
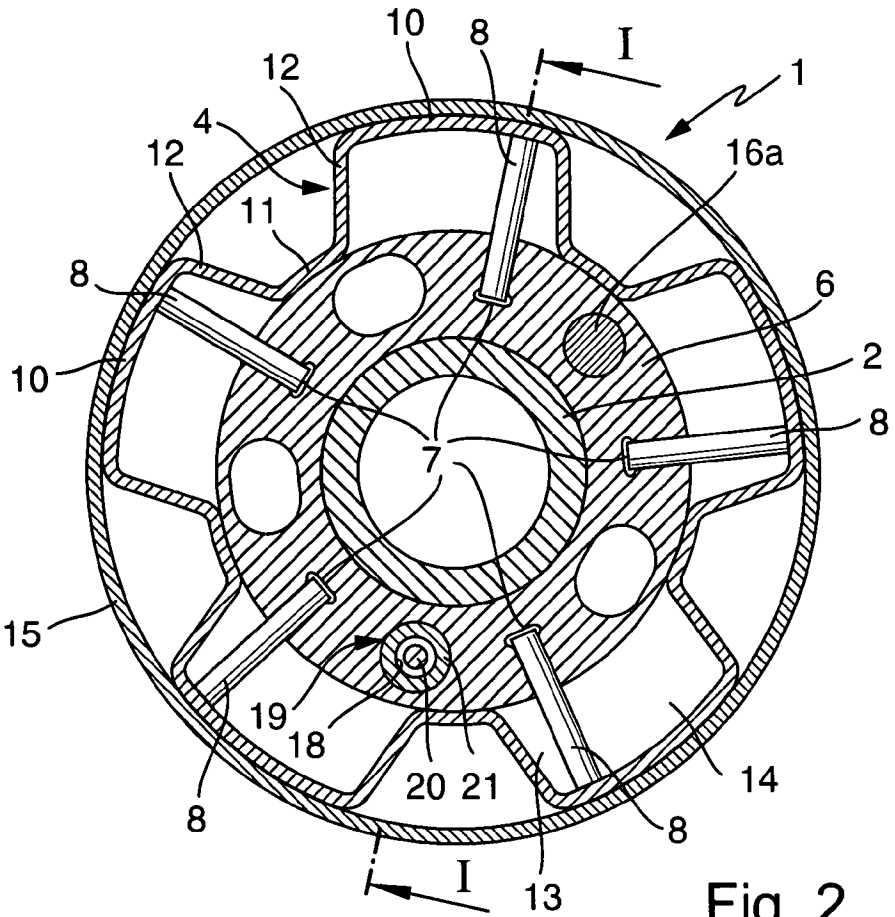
FIG. 2 is a view of the camshaft adjuster according to the invention from FIG. 1 in cross section along the line II-II.

The essential parts of a camshaft adjuster 1 in a rotary-piston structural type for adjusting the rotational angle of a camshaft 2 relative to a not-shown crankshaft follow from FIGS. 1 and 2. The camshaft adjuster 1 is driven by a driving wheel 3, which is embodied as a chain wheel in the shown embodiment. Embodiments, in which the driving wheel 3 is formed as a belt or gear wheel, are also conceivable. The camshaft adjuster 1 essentially comprises a stator 4 connected rigidly to the driving wheel 3 and a driven part 6 connected in a rotationally fixed way to the camshaft 2. The space between the driven part 6 and the stator 4 is bounded by the driving wheel 3 and an end wall 5. The driven part 6 is formed as a vane wheel. It comprises a generally cylindrical body, wherein axial grooves 7, in which radially outwards projecting vanes 8 are arranged, are formed in the outer surface of the cylindrical body. The driven part 6 can be manufactured, for example, in a metal-cutting process or it can be a sintered part. Furthermore, it is conceivable to manufacture the driven part 6 in a non-cutting method, for example, through a multiple stamping process.

The vanes 8 are pressed radially outwards by means of springs 9, which are mounted on the radially inner end of the vane 8, whereby they come to contact an outer wall 10 of the stator 4. The stator 4 of the camshaft adjuster 1 forms first and second compression chambers 13, 14 by means of outer walls 10 and inner walls 11 running in the circumferential direction and by means of essentially radial connecting walls 12 with the driven part 6, its vane 8, the driving wheel 3, and the end wall 5. Through suitable connection of the individual compression chambers 13, 14 with a hydraulic medium pump or the hydraulic medium outlet, the phase position of the driven part 6 can be adjusted or maintained relative to the stator 4 and thus the camshaft 2 relative to the crankshaft.

The driving part 6 and the stator 4 are arranged in a housing 15, which seals the first and second compression chambers 13, 14 from the outside. The housing 15 is connected to the driving wheel 3 by an annular, surrounding weld connection 15*a*. Furthermore, a connecting link 16, in which an element 16*a* for limiting the rotational angle engages, is formed on the driving wheel 3. For the purpose of sealing the compression chambers 13, 14, a sealing disk 17, which is adapted to the diameter of the stator 4, is inserted between the housing 15 and stator 4.

In addition, a locking element 19 is arranged within the driven part 6 in an axial bore hole 18. A spring element 20 here applies a force on a piston 21 in the direction of the driving wheel 3. Especially during the startup process of the internal-combustion engine, the piston 21 is pressed into a recess 22 of the driving wheel 3 by the spring element 20, whereby undesired rotation of the driven part 6 relative to the driving wheel 3 is effectively prevented. During the operation of the internal-combustion engine, the recess 22 is charged with hydraulic medium, whereby a force directed in the axial direction against the spring element 20 acts on the piston 21. Therefore, the piston 21 is displaced into the axial bore hole 18, whereby the driven part 6 can rotate relative to the driving wheel 3.

The stator 4, the sealing disk 17, and also the housing 15 are components manufactured using a non-cutting method from a sheet-metal part. Naturally, the invention can also be used in other variants of rotary-piston adjusters, for example, with stators 4 that have been sintered or cut.

To implement a change of the phase position between the crankshaft and camshaft 2, either the first or the second compression chambers 13, 14 are charged with hydraulic medium, wherein the other pressure chambers 13, 14 are connected to a compressed-medium reservoir. For maintaining a certain phase position, either both the first and also the second compression chambers 13, 14 can be charged with hydraulic medium, or else the two can be separated from both the compressed-medium reservoir and also from the hydraulic-medium source.

The driven part 6 is fixed with a frictional connection to the camshaft 2 in the embodiment shown in FIG. 1. For assembly, the driven part 6 is heated and joined to the camshaft 2 with minimal play. The frictional connection between the camshaft 2 and the driven part 6 is created by the subsequent cooling and thus shrinking process of the driven part 6. Likewise, it is conceivable that the driven part 6 is configured with a projection, over which an at least partially hollow camshaft 2 is joined and fixed with a frictional connection.

The technique of expansion represents another possibility for creating the frictional connection between the camshaft 2 and driven part 6. Here, the driven part 6 is joined to the camshaft 2 with minimal play and then the camshaft 2 expands. For this purpose, in addition to the technique of inner high pressure deformation by means of a compressed medium, expansion processes by means of pushing through a suitable tool are also conceivable. In one embodiment of the invention, the tool is a body that is rotationally symmetric in the circumferential direction of the camshaft 2, such as, for example, a ball. Therefore, a uniform frictional connection between the driven part 6 and camshaft 2 is achieved in the circumferential direction. Also conceivable are profiled tools, for example, a star-shaped tool, whereby, in addition to the frictional connection in the circumferential direction, a positive-fit connection is also achieved. In addition to star-shaped tools, n-edge tools or polygonal connections are also conceivable.

Figure 3:
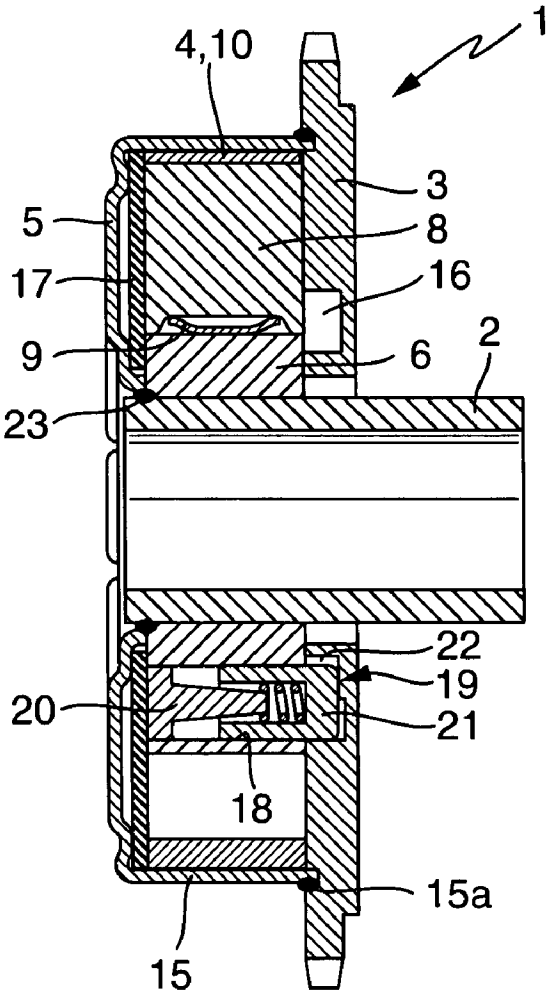
FIG. 3 is a longitudinal section view of a second embodiment of a camshaft adjuster according to the invention, which is connected by means of a weld connection to the camshaft.

Another embodiment of the invention is shown in FIG. 3. The camshaft adjuster 1 shown here is identical in form and function to that in FIGS. 1 and 2, and the same components bear the same reference numbers. The sole difference lies in the attachment method of the driven part 6 to the camshaft 2. This is realized by a weld connection 23 to the separating joint between camshaft 2 and driven part 6. The weld connection 23 can be either a completely surrounding weld seam or a segmented weld seam.

Figure 4:
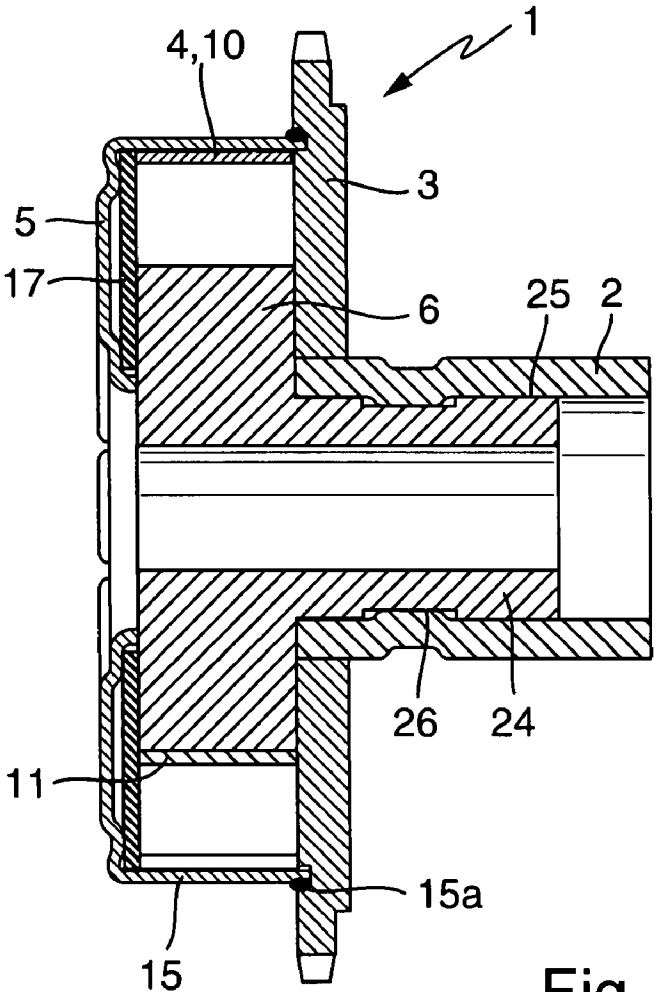
FIG. 4 is a longitudinal section view of a third embodiment of a camshaft adjuster according to the invention.

In FIG. 4, another embodiment of a camshaft adjuster 1 according to the invention is shown. This camshaft adjuster 1 is also identical to a large degree to that shown in FIGS. 1 and 2, and the same reference numbers are used for the same parts. Deviating from the camshaft adjuster 1 shown in FIG. 1, the driven part 6 in this embodiment is provided with a projection 24. The projection 24 is provided on its outer surface 25 with at least one section 26 of reduced diameter. Here, the section/s 26 of reduced diameter can be both an annular, surrounding groove and also individual beads. The at least partially hollow camshaft 2 overlaps the projection 24, wherein it is protected by a positive-fit connection against axial creep. This is achieved in that material of the hollow part of the camshaft 2 is displaced into the section 26 of reduced diameter of the projection 24, which can be achieved, for example, by round rolling.

Obviously, two or more attachment methods can also be combined in order to increase the strength of the connection between camshaft 2 and driven part 6.

LIST OF REFERENCE SYMBOLS

1 Camshaft adjuster
2 Camshaft
3 Driving wheel
4 Stator
5 End wall
6 Driven part
7 Groove
8 Vane
9 Spring
10 Outer wall
11 Inner wall
12 Connecting wall
13 First compression chamber
14 Second compression chamber
15 Housing
**15*a*** Weld connection
16 Connecting link
**16*a*** Element
17 Sealing disk
18 Axial bore hole
19 Locking element
20 Spring element
21 Piston
22 Recess
23 Weld connection
24 Projection
25 Outer surface
26 Section of reduced diameter

The invention claimed is:

1. Camshaft adjuster (1) for adjusting and fixing a phase position of a camshaft (2) of an internal-combustion engine relative to a phase position of a crankshaft, comprising:
- a driving wheel (3) driven by the crankshaft,
- a driven part (6) fixed to the camshaft,
- the driven part is mounted on a camshaft (2) or an extension of the camshaft (2), and
- the driven part is driven by the driving wheel (3),
- wherein the phase position of the driven part (6) is adjustable relative to the driving wheel (3) within a certain range of angles, and
- the driven part (6) is fixed to the camshaft (2) or the extension of the camshaft (2) with a positive-fit connection,
- wherein the driven part (6) is formed with an axially extending projection (24), over which the camshaft (2) or the extension of the camshaft (2) is pushed, wherein an outer surface (25) of the projection (24) is configured with at least one local section (26) of reduced diameter, into which material of the camshaft (2) or the extension of the camshaft (2) is displaced.

2. Camshaft adjuster (1) according to claim 1, wherein the local section (26) of reduced diameter is an annular groove.

3. Camshaft adjuster (1) according to claim 1, wherein several local sections (26) of reduced diameter, which are spaced apart from each other in an axial or circumferential direction, are provided.

4. Camshaft adjuster (1) for adjusting and fixing a phase position of a camshaft (2) of an internal-combustion engine relative to a phase position of a crankshaft, comprising:
- a driving wheel (3) driven by the crankshaft,
- a driven part (6) fixed to the camshaft,
- the driven part is mounted on a camshaft (2) or an extension of the camshaft (2), and
- the driven part is driven by the driving wheel (3),
- wherein the phase position of the driven part (6) is adjustable relative to the driving wheel (3) within a certain range of angles, and
- the driven part (6) is fixed to the camshaft (2) or the extension of the camshaft (2) with a positive-fit connection,
- wherein the driven part (6) is formed with an axially extending projection (24), which is pushed over the camshaft (2) or the extension of the camshaft (2), wherein an outer surface of the camshaft (2) or the extension of the camshaft (2) is configured with at least one local section (26) of reduced diameter, into which material of the projection (24) is displaced.

* * * * *